United States Patent [19]

Nordlinger

[11] 4,039,274

[45] Aug. 2, 1977

[54] ELECTRIC SAFETY LIGHTER

[75] Inventor: Mildred Nordlinger, New York, N.Y.

[73] Assignee: Westminster Industries, Inc., New York, N.Y.

[21] Appl. No.: 656,835

[22] Filed: Feb. 10, 1976

[51] Int. Cl.[2] ..... F23O 7/00

[52] U.S. Cl. ..... 431/128; 431/132; 431/320; 431/324

[58] Field of Search ..... 431/273, 320, 324, 132, 431/253, 127, 128

[56] References Cited

U.S. PATENT DOCUMENTS

| | | | |
|---|---|---|---|
| 914,964 | 3/1908 | Mantion et al. | 431/128 |
| 1,207,631 | 12/1905 | Rokeach | 431/127 |
| 2,496,257 | 2/1950 | Bachrach | 431/127 |
| 2,656,492 | 10/1953 | Faulkner | 431/128 |

*Primary Examiner*—Edward G. Favors
*Assistant Examiner*—Robert J. Charvat
*Attorney, Agent, or Firm*—Amster & Rothstein

[57] ABSTRACT

An electric safety lighter is provided which requires the preliminary step of immersing a normally dry wick into a reservoir of lighter fluid before a flame can be produced. This additional step precludes inadvertent operation of the lighter by a child and thus performs a valuable safety function. In addition, by maintaining the wick normally removed from the reservoir, lighter fluid evaporation is minimized.

2 Claims, 3 Drawing Figures

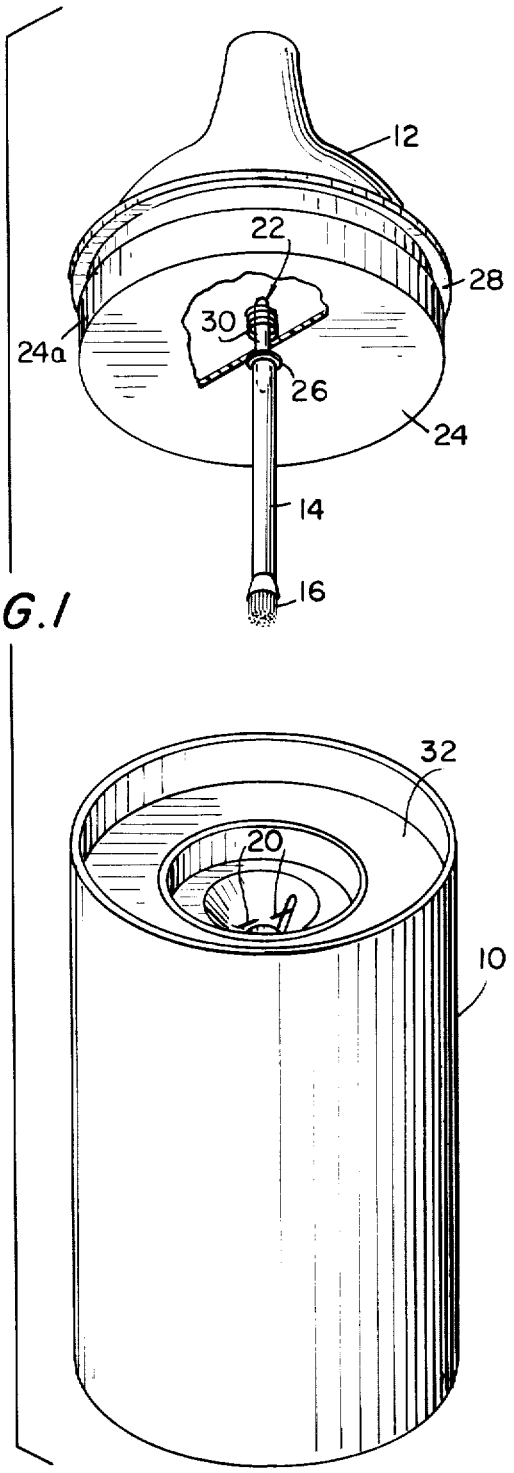
FIG. 1
FIG. 2
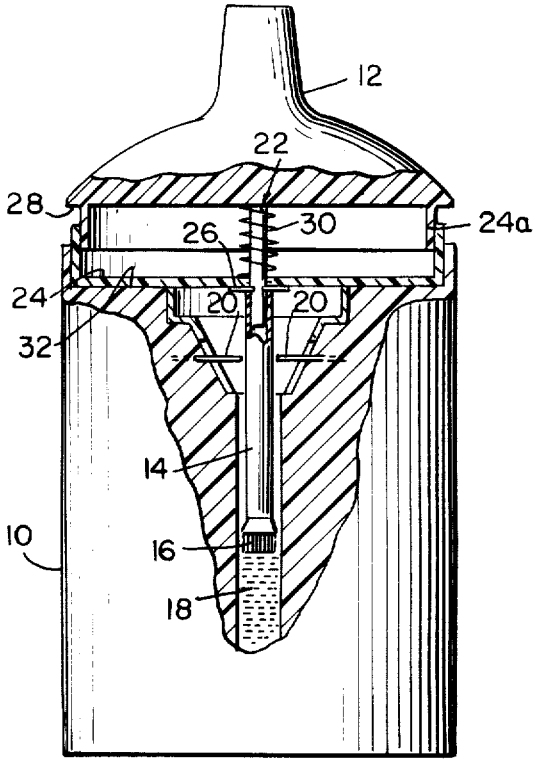
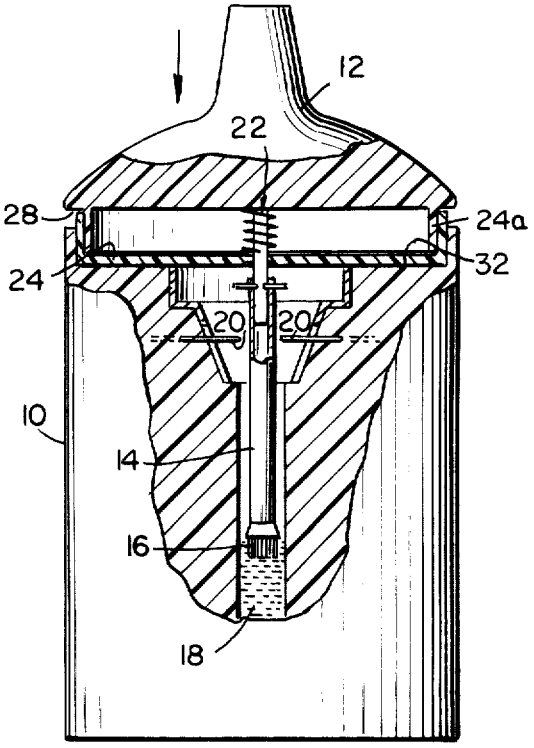
FIG. 3

ELECTRIC SAFETY LIGHTER

The present invention relates generally to a safety lighter which requires a preliminary operation to be performed before the lighter can operate, so as to preclude inadvertent operation.

Wick-type lighters have recently become very popular. These lighters operate on the following principle:

A wick of suitable material mounted at the end of a rod is normally immersed in a reservoir of lighter fluid within a lighter chassis. Striker means are provided for creating a spark as the wick is withdrawn from the chassis, with the spark igniting the wick and creating a flame at the end of the rod. One difficulty with prior lighters of this type is that the flame may be created unintentionally. For example, a child might pull the rod out of the chassis, thus producing a flame. Another difficulty with prior lighters of this type is that by maintaining the wick normally immersed in the reservoir, a substantial quantity of lighter fluid, needlessly absorbed by the wick, is evaporated and thereby wasted.

It is an object of the present invention to provide a lighter which requires at least a minimal degree of dexterity and sophistication to operate, thus overcoming the problem of prior lighters being susceptible to accidental use by children.

It is a further object of the present invention, by maintaining the wick normally removed from the reservoir, to minimize the wasting of lighter fluid.

In accordance with an illustrative embodiment demonstrating objects and features of the present invention, there is provided an electric lighter which provides for a preliminary step in its operation. The lighter includes a wick of suitable material positioned at one end of a rod disposed within, and removable from, a chassis. The chassis includes a reservoir of lighter fluid, striker means, and means for suspending the wick above the reservoir. A spring mechanism is provided so that, upon depression of the rod, the wick communicates with the reservoir. In order to produce a flame, it is first necessary to depress the rod, causing the spring mechanism to compress, and allowing the normally dry wick to communicate with the reservoir and thus to absorb a quantity of lighter fluid. Upon withdrawal of the rod from the chassis, a spark is created adjacent the wick, causing the wick to ignite. Thus upon full withdrawal of the rod from the chassis, the wick is lit and the flame may be used as intended. When the flame has been so utilized, the rod is replaced in the chassis and the flame is thereby extinguished.

The above brief description of the present invention will be more fully appreciated by reference to the following detailed description of a presently preferred, but nonetheless illustrative, embodiment in accordance with the invention, when taken in conjunction with the accompanying drawings, wherein:

FIG. 1 is a perspective view of the lighter with the rod withdrawn from the chassis;

FIG. 2 is a cross-sectional view of the lighter with the dry wick in its rest position, normally separate from the reservoir;

FIG. 3 is a cross-sectional view of the lighter where the spring has been compressed so as to immerse the wick in the reservoir, causing the wick to absorb a quantity of lighter fluid.

Referring more specifically to the drawings, applicant's safety lighter shown in FIG. 1 includes a chassis section 10 and a chassis cover 12. Chassis cover 12 carries a depending rod 14 having a wick 16 at its end. As previously described, chassis 10 includes a reservoir of lighter fluid 18 (in FIGS. 2 and 3) which provides lighter fluid to wick 16, and striker means including spark contacts 20 which communicate with an electric system (not shown) to produce a spark adjacent wick 16 as chassis cover 12 is removed, igniting wick 16 and producing the lighter flame. The electrical system associated with spark contacts 20 is of a type well known in the art and will not be described herein in detail.

As indicated above, in the conventional lighter system of this type wick 16 would be immersed in reservoir 18 whenever chassis cover 12 was in place in chassis 10, thus creating a danger that the lighter would be inadvertently ignited by a child, and wasting lighter fluid through evaporation.

In order to overcome these deficiencies, applicant's novel lighter includes a suspension mechanism which supports chassis cover 12 in a position so as to maintain wick 16 separate from reservoir 18 when the lighter is not in use and to permit immersion of wick 16 in reservoir 18 immediately prior to use of the lighter.

To accomplish this objective, rod 14 is permanently fixed in chassis cover 12 at point 22. A support disc 24 is slideably mounted on rod 14 with rod 14 passing through an aperture in approximately the center of the disc. The lowermost sliding position of disc 24 on rod 14 is established by a shoulder 26 on rod 14 where the rod diameter is expanded beyond the diameter of the aperture in disc 24. The uppermost sliding position of disc 24 on rod 14 is established by an upstanding skirt **24*a* which is positioned to abut against a circumferential stop ledge 28 at the periphery of chassis cover 12. Disc 24 is thus free to slide on rod 14 from an upper position where 24*a* abuts against stop ledge 28 and a lower position where the region of disc 24 adjacent the aperture abuts against shoulder 26. A coil spring 30 is provided on rod 14 between the rod's fixed position (22) in chassis cover 12 and the disc 24. The spring 30 is normally under slight compression maintaining disc 24 in its lowermost position against shoulder 26**.

When chassis cover 12 is in its rest position on chassis 10 disc 24 abuts against shoulder 32 which is dimensioned so as to support wick 16 above the level of reservoir 18. In this condition, the wick is normally dry so that it will not ignite if removed, and evaporation of the lighter fluid is kept to a minimum.

It will be appreciated that with the lighter in its rest position, disc 24 is in its lowermost position on shoulder 26 and supports rod 14, and hence wick 16, in a position where the wick is removed from the lighter fluid. Prior to withdrawal of the rod for use, downward pressure is applied to chassis cover 12 which compresses spring 30, driving rod 14 downwardly until wick 16 is immersed in reservoir 18. The cover and wick assembly is immediately removed with spark contacts 20 creating a spark adjacent wick 16 as the rod is withdrawn from the lighter igniting wick 16 and creating the lighter flame for use.

This mechanism thus provides the need for a preliminary step, i.e., depressing chassis cover 12 before the lighter is in condition for use so as to prevent inadvertent use of the lighter, for example, by a child. At the same time, wick 16 is normally suspended (as shown in FIG. 2) above reservoir 18 keeping evaporation of the lighter fluid to a minimum.

It is to be understood that the above detailed description relates to a presently preferred embodiment of the invention. Numerous modifications, substitutions and additions will be apparent to those skilled in the art without departing from the spirit and scope of applicant's invention as defined in the following claims.

What is claimed is:

1. A lighter comprising a chassis, a reservoir for lighter fluid within said chassis, a rod having a wick at one end, support means comprising a slidable disc mounted transverse to said rod for axial sliding movement with respect to said rod for suspending said rod within said chassis with the wick normally separated from the reservoir, spring means operationally associated with said support means such that upon actuation of said spring means the wick end of the rod comes in contact with the reservoir and absorbs lighter fluid from said reservoir, said spring means being secured between a fixed position on said rod and said disc, said disc engaging said chassis such that compression of said spring moves said wick from a position separate from the reservoir to a position in contact with said reservoir, and striker means for igniting said wick upon withdrawal of said rod from said chassis.

2. Apparatus in accordance with claim 1 wherein said spring is a coil spring positioned around said rod intermediate said fixed point and said disc.

* * * * *